United States Patent [19]

Yoshida et al.

[11] Patent Number: 4,475,029

[45] Date of Patent: Oct. 2, 1984

[54] CERAMIC HEATER

[75] Inventors: Hitoshi Yoshida, Kariya; Shunzo Yamaguchi, Okazaki; Morihiro Atsumi, Toyohashi; Takeshi Fukazawa; Tomio Kumoi, both of Kariya, all of Japan

[73] Assignee: Nippondenso Co., Ltd., Kariya, Japan

[21] Appl. No.: 471,158

[22] Filed: Mar. 1, 1983

[30] Foreign Application Priority Data

Mar. 2, 1982 [JP] Japan ..... 57-32594
May 25, 1982 [JP] Japan ..... 57-89555
Sep. 28, 1982 [JP] Japan ..... 57-169188

[51] Int. Cl.[3] ..... F23Q 7/22

[52] U.S. Cl. ..... 219/270; 123/145 A; 219/260; 219/523; 219/553; 338/326; 338/330; 361/266; 252/520

[58] Field of Search ..... 219/260, 267, 270, 523, 219/553; 123/145 A, 145 R; 361/264, 265, 266; 431/262; 338/326, 330; 373/134; 252/514, 518, 520

[56] References Cited

U.S. PATENT DOCUMENTS 3,372,305 3/1968 Mikulec ..... 219/270 X
3,397,375 8/1968 Casper et al. ..... 338/330
3,709,998 1/1973 Anthony et al. ..... 373/134
3,842,319 10/1974 Perl ..... 219/270 X
3,875,477 4/1975 Fredriksson et al. ..... 361/264
4,058,701 11/1977 Gruber et al. ..... 219/270
4,090,054 5/1978 Heine et al. ..... 219/10.49 R
4,101,454 7/1978 Kulwicki et al. ..... 252/514
4,302,659 11/1981 Horiba et al. ..... 219/270
4,401,065 8/1983 Minegishi et al. ..... 123/145 A
4,426,568 1/1984 Kato et al. ..... 219/270

FOREIGN PATENT DOCUMENTS 1213669 3/1966 Fed. Rep. of Germany ... 123/145 A
549628 12/1952 Japan .

*Primary Examiner*—Volodymyr Y. Mayewsky
*Attorney, Agent, or Firm*—Cushman, Darby & Cushman

[57] ABSTRACT

A ceramic heating element is held in a metal housing to be mounted on an internal combustion engine, so that the heating element is operated as a glow plug for igniting an air-fuel mixture. The ceramic heating element is formed of an electrode section housed in the housing and a heat generating section extending out of the housing, whereby the heat generating section is exposed to the mixture in an engine cylinder. The electrode and heat generating sections are divided into two portions, respectively, and both forward ends of divided heat generating portions are connected with each other, so that electric current flows from one of the electrode portions through the divided heat generating portions to the other electrode portion.

2 Claims, 26 Drawing Figures

CERAMIC HEATER

FIELD OF THE INVENTION

This invention relates to a ceramic heater having a ceramic heating element which generates heat when supplied with an electric current. More particularly, it is concerned with such a ceramic heater used as a glow plug for a diesel engine.

DESCRIPTION OF THE PRIOR ART

In a compression ignition engine such as a diesel engine, a high pressure jet of fuel is injected into a combustion chamber of a cylinder for spontaneous ignition upon contacting air having a high pressure and a high temperature. If the ambient temperature is low, however, it is difficult to ignite the fuel and to start the engine, since the air temperature is not raised sufficiently by compression. In order to facilitate the ignition of the fuel in the combustion chamber, it is usual to employ an electrically heated auxiliary spark plug which is called a glow plug. It is an electrically heated plug having a heating element formed of a ceramic or other non-metallic resistor. The heating element, which is, for example, made of silicon carbide, is of the exposed type. This glow plug, however, has a number of outstanding problems, including ignition performance, power consumption by the heating element, and its breakage. Japanese Unexamined Utility Model Publication No. 95628/1979, for example, proposes a plug comprising a ceramic heater tube closed at one end which is reduced in diameter to define inwardly an electrode at which heat is generated, while another electrode is formed on the other end of the tube. This plug is more effective for ignition of the mixture than a conventional plug covered by a protective metal tube, since the heating element is exposed, and since in the case of a slitted heating element, it has an enlarged surface area. The heat emitted from the outer exposed surface of the ceramic tube is used to ignite the fuel. The heat generated within the tube is, however, deprived to heat the metal electrode and an insulating powder filling the tube. In view of its power consumption, therefore, the conventional plug having the protective tube was not satisfactory in ignition efficiency. Another problem resides in the position of one of the electrodes. It is provided at the hottest point where the metallic central electrode and the ceramic tube are coaxially connected with each other. Special measures need be taken to ensure reliable connection between the central electrode and the ceramic tube. The plug is, therefore, complicated in construction, resulting in a reduction of productivity, and the likelihood of occurrence of breakage or like trouble.

SUMMARY OF THE INVENTION

It is an object of this invention to provide a ceramic heater having an electrode positioned in a low temperature region. It is another object of this invention to provide a ceramic heater having an electrode positioned in a region remote from the hottest area, and a heating element of which has a maximum possible surface working effectively for ignition purposes.

These objects are attained in accordance with this invention by a ceramic heating element adapted to generate heat when supplied with electricity, the element being in the form of a rod having at least one axially extending slit which splits the rod except for one end thereof and defines at least two electrode portions at the other end thereof. The ceramic heater of this invention is of great practical use, since it has improved ignition efficiency, electrode stability, productivity and durability. In the ceramic heater of this invention, the heating element heated by power application provides effective heat to facilitate the ignition of fuel not only on the surface of the heating element, but also in the slit. The heating element is quickly heated. The heater is so designed that only the heating element is heated. The heater of this invention is, thus, very effective for power saving.

It is still another object of this invention to provide in the ceramic heater of the construction as hereinabove described a structure which ensures that the electrode portions defined by the split ends of the heating element be reliably connected to a power source.

This object is attained in accordance with this invention by a simple structure comprising a metallic housing, and an electrode member which is disposed in the housing in an electrically insulated fashion. The two electrode portions of the heating element are disposed in the housing, and one of the electrode portions is electrically connected to the housing, while the other electrode portion is electrically connected to the electrode member. If a voltage is applied between the housing and the electrode member, an electric current can be supplied to the whole heating element to heat it effectively in its entirety.

It is a further object of this invention to provide a structure which facilitates positioning of the housing and the ceramic heating element in axial alignment with each other. Two arrangements are available for attaining this object in accordance with this invention. According to one of the arrangements, an electrical insulating layer having an equal thickness is formed on a part of the outer periphery of one end of the ceramic heating element, and also on the entire outer periphery of the other end thereof. The electrical insulating layers of equal thickness formed about the opposite ends of the heating element ensure alignment of the heating element with the housing without requiring any complicated structure. Such alignment can be achieved only if the opposite ends of the heating element are positioned in the housing. At one end of the heating element, the electrical ensulating layer is provided on only a part of its outer periphery, so that the area in which no such layer is formed may be provided with a metallizing layer which enables the end of the element to be secured to the housing by brazing, and establishes electrical connection with the housing. At the other end of the heating element, the electrical insulating layer is formed on its entire outer periphery, so that the entire surface of the insulating layer may be provided with a metallizing layer which enables the other end of the element to be secured to the housing by brazing, and establishes electrical insulation therebetween. The metallizing layers must, of course, be of equal thickness on both ends of the heating element in order to ensure axial alignment between the heating element and the housing.

The other arrangement employs a hollow electrically insulated ceramic sleeve. The ends of the heating element are secured within one end of the sleeve, while the other end of the sleeve is secured within the housing. The sleeve ensures axial alignment between the housing and the heating element, and also prevents transfer of heat from the heating element to the housing.

DETAILED DESCRIPTION OF THE PREFERRED EMBODIMENTS

Figure 1:
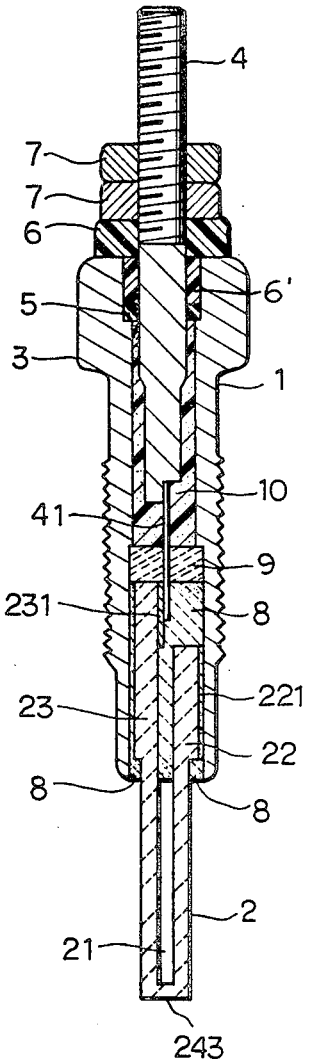
FIG. 1 is a longitudinal sectional view of a glow plug according to this invention.
Figure 2:
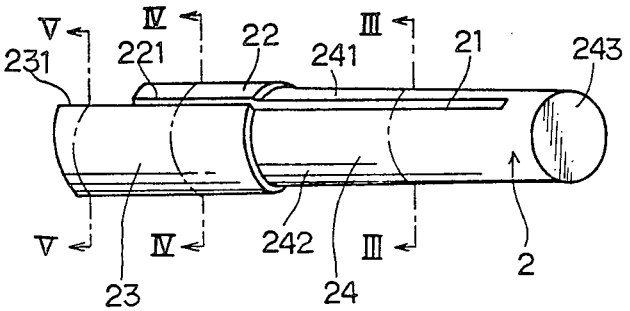
FIG. 2 is a perspective view of a ceramic heating element in the glow plug of FIG. 1.
Figure 3:
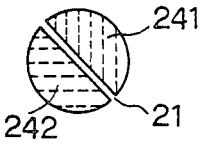
FIGS. 3, 4 and 5 are sectional views taken along the lines III—III, IV—IV and V—V, respectively, of FIG. 2.
Figure 4:
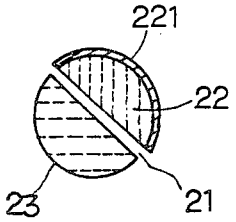
Figure 5:
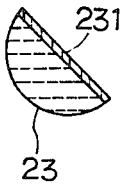

Referring first to FIG. 1 of the drawings, a glow plug for a diesel engine according to this invention comprises a mounting portion 1 and a heating element 2. The mounting portion 1 comprises a cylindrical metallic housing 3 for mounting on a cylinder head of a diesel engine not shown, a rod-shaped central electrode 4 disposed in the center of the housing 3 in an electrically insulating fashion, a heat-resistant rubber packing 5, a bakelite bush 6, an insulator 6', and a nut 7 which ensures connection of a lead wire to the central electrode 4. The heating element 2 comprises a rod of a ceramic material, and projects from one end of the housing 3. The shape and construction of the heating element 2 are shown in detail in FIGS. 2 to 5. FIG. 2 is a perspective view of the heating element 2, and FIGS. 3 to 5 are sectional views taken along the lines III—III, IV—IV and V—V respectively, of FIG. 2. The generally rod-shaped heating element 2 has one end secured in the housing 3, and includes an increased diameter portion having a length which occupies about one-third of the entire length of the heating element 2. The heating element 2 has a slit 21 which extends axially from one end thereof to a point close to the other end thereof. The slit 21 splits the increased diameter portion into two electrode portions 22 and 23, while the smaller diameter portion defines a heat generating portion 24. The electrode portion 22 is smaller in length than the electrode portion 23, and therefore, the electrode portion 23 projects beyond the electrode portion 22. A metallizing layer 231 is formed on the projecting surface of the electrode portion 23 facing the slit 21, and bonded firmly by brazing to a terminal 41 on the central electrode 4. A metallizing layer 221 is formed on the arcuate surface of the electrode portion 22, and bonded firmly by brazing to the inner wall surface of the housing 3.

The heat-generating portion 24 comprises columnar portions 241 and 242 divided by the slit 21 from each other and each having a semicircular cross section, and an end 243 through which the slit does not extend. The heat-generating portion 24 is located outside the housing 3. The gap between the electrode portion 23 and the housing 3 is filled with a heat-resistant alumina-based ceramic adhesive 8 which provides electrical insulation and gas tightness, and a perforated alumina-based ceramic spacer 9 is disposed in intimate contact with the housing 3 to hold the central electrode 4 in the position, as shown in FIG. 1. The space defined by the spacer 9, the packing 5, the central electrode 4 and the housing 3 is filled with a mixture 10 of a ceramic powder, such as of magnesium oxide, and a thermosetting resin, such as an epoxy resin.

The heating element 2 is a resistor formed of a composite ceramic material composed of titanium carbide and alumina, and having a specific resistance of about $4\times10^{-3}$ Ωcm. It may, for example, be formed as will hereinafter be described. Appropriate quantities of methyl cellulose and water are added into a mixture composed of 30% by weight of titanium carbide and 70% by weight of alumina to prepare a clay, and the clay is extrusion molded into a columnar molded product. The molded product is cut to an appropriate length, and after appropriately sized heat-generating and electrode portions have been formed by grinding, a slit is cut therein. The product thus formed is fired at 1,700° C. for two hours in an argon atmosphere to yield a ceramic heating element 2. The heating element 2 may also be formed of a composite ceramic material composed of titanium nitride and alumina, or other heat-generating materials, such as silicon carbide, molybdenum disilicide and lanthanum chromite.

The glow plug as hereinabove described is mounted by its mounting portion 1 on the cylinder head of a diesel engine. If a power source is connected to one end of the central electrode 4, an electric current flows through the central electrode 4, the metallizing layer 231, the electrode portion 23, the columnar portion 242 of the heating element 2, its end 243, its columnar portion 241, the electrode portion 22, the metallizing layer 221 and the housing 3. Joule's heat is generated in the columnar portions 241 and 242 and the end 243 of the heat-generating portion 24 and utilized to ignite fuel. The generation of heat is concentrated in the heat-generating portion 24, since it is smaller in cross-sectional area than the electrode portions 22 and 23, and therefore greater in resistance. The fuel injected by a fuel injection valve reaches not only the surfaces of the columnar portions 241 and 242 and the end 243, but also the interior of the slit 21. Accordingly, the majority of the heat generated on these surfaces of the heat-generating portion is used very efficiently for igniting the fuel.

The glow plug of this invention supplies heat very quickly, since the heating element 2 is exposed. It is substantially free from any trouble arising from a temperature rise in the housing 3, since the electrode portions 22 and 23 are greater in cross-sectional area than the heat-generating portion 24, and therefore lower in resistance and hence in temperature. The heat-generating portion 24 exposed to a high temperature is free from any danger of breakdown, since it is simple in construction. The generation of heat can be concentrated to a greater extent in the end 243, if the slit 21 is increased in length to reduce the thickness of the end 243.

Although in the device hereinabove described, the heating element 2 is columnar, and has only a single slit 21, the heating element can be realized in various other shapes, depending on the desired distribution of heat and the construction of the engine involved, as will hereinafter be set forth.

Figure 6:
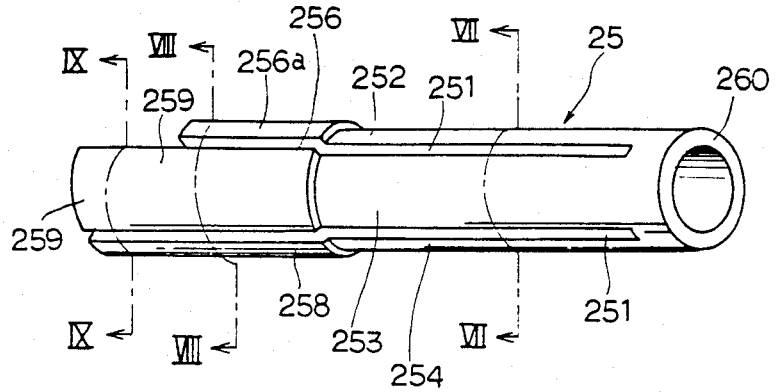
FIG. 6 is a perspective view of another heating element.
Figure 7:
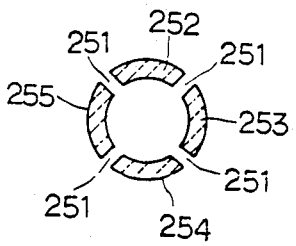
FIGS. 7, 8 and 9 are sectional views taken along the lines VII—VII, VIII—VIII and IX—IX, respectively, of FIG. 6.
Figure 8:
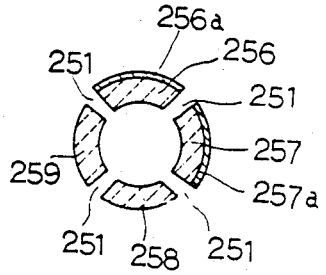
Figure 9:
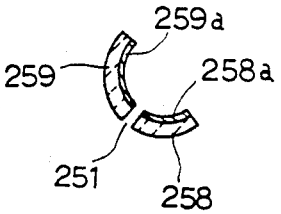

A heating element 25 having four slits is shown in FIGS. 6 to 9. FIG. 6 is a perspective view of the heating element 25, and FIGS. 7 to 9 are sectional views taken along the lines VII—VII, VIII—VIII, and IX—IX, respectively, of FIG. 6. It is in the from of a hollow cylinder having an increased diameter portion at one end having a length which occupies about one-third of the entire length of the heating element. The four slits 251 extend along the increased diameter portion and a smaller diameter portion, and terminate adjacent to the other end of the heating element 25. The smaller diameter portion defines four arcuate heat-generating portions 252 to 255 and an annular heat-generating portion 260 at the end thereof. The increased diameter portion defines four electrode portions 256 to 259. Two electrode portions 256 and 257 are shorter than the other two. An electrically conductive metallizing layer 256*a* or 257*a* is formed on the outer peripheral surface of each of the electrode portions 256 and 257, and firmly secured by brazing to the inner wall surface of a housing. The other electrode portions 258 and 259 extend axially beyond the electrode portions 256 and 257, and the extension of each of them has an inner surface provided with a metallizing layer 258*a* or 259*a* which is in turn secured by brazing to a central electrode. If the heating element 25 is employed in a glow plug, the heat thereby generated can be utilized very effectively for igniting fuel, since the fuel reaches not only the outer periphery of the heating element 25, but also its slits 251 and hollow interior. The heating element 25 facilitates ignition, since gasified or vaporized fuel is easy to store in the hollow interior and slits 251 thereof.

Figure 10:
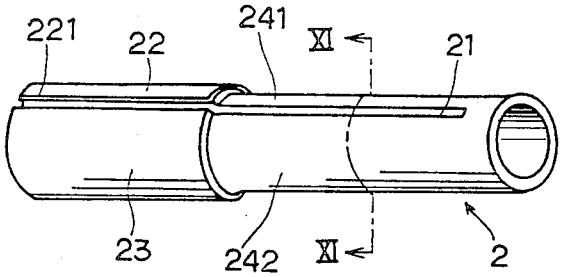
FIG. 10 is a perspective view of still another heating element.
Figure 11:
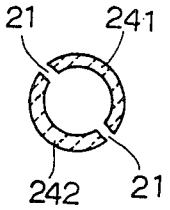
FIG. 11 is a sectional view taken along the line XI—XI of FIG. 10.
Figure 12:
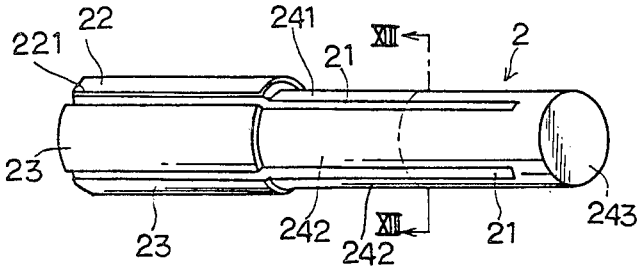
FIG. 12 is a perspective view of still another heating element.
Figure 13:
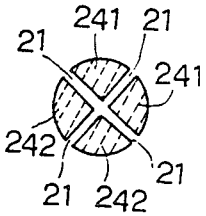
FIG. 13 is a sectional view taken along the line XIII—XIII of FIG. 12.
Figure 14:
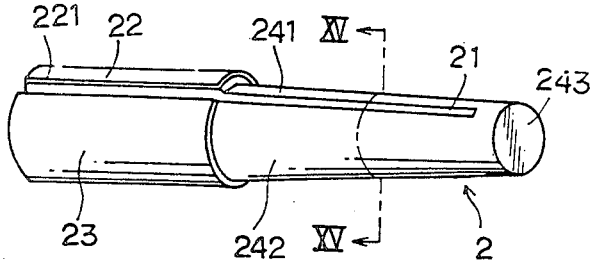
FIG. 14 is a perspective view of still another heating element.
Figure 15:
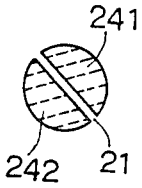
FIG. 15 is a sectional view taken along the line XV—XV of FIG. 14.
Figure 16:
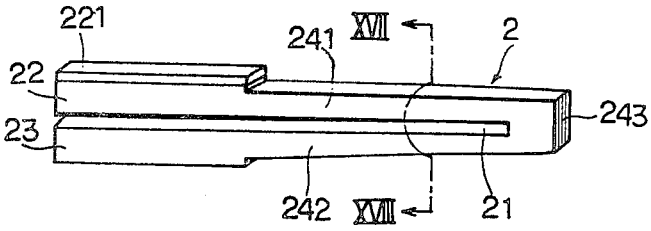
FIG. 16 is a perspective view of still another heating element.
Figure 17:
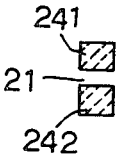
FIG. 17 is a sectional view taken along the line XVII—XVII of FIG. 16.

Four other modifications of the heating element are shown in FIGS. 10 to 17. Referring first to FIGS. 10 and 11, a heating element 2 comprises a hollow cylinder having two slits 21. Referring to FIGS. 12 and 13, a heating element 2 which is similar to that shown in FIG. 2 has two slits 21 which define four columnar portions. The heating element 2 shown in FIGS. 14 and 15 is similar to that shown in FIG. 2, but gradually reduced in diameter toward the end of the heat-generating portion so that a greater amount of heat may be generated toward the end of the heat-generating portion. The heating element 2 shown in FIGS. 16 and 17 is rectangular in cross-section, and an example which testifies that the cross-section of the heating element is not limited to annular or circular.

Figure 18:
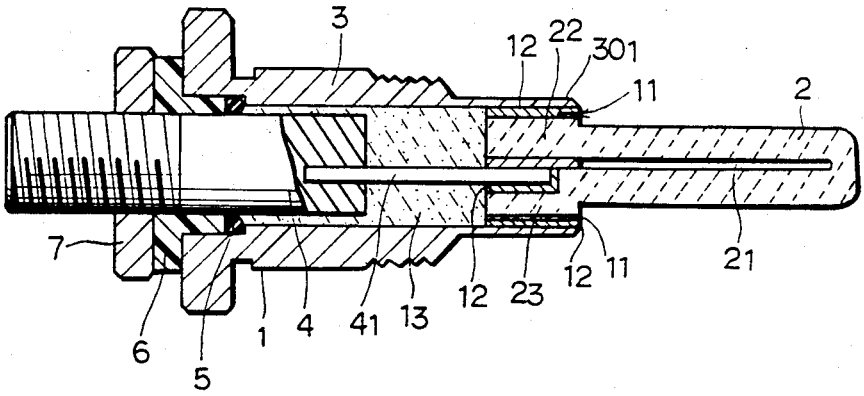
FIG. 18 is a longitudinal sectional view of another glow plug according to this invention.
Figure 19A:
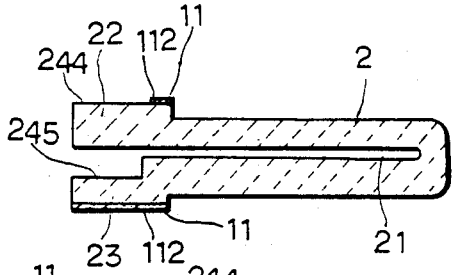
FIGS. 19A and 19B are a longitudinal sectional view and a left end view of a ceramic heating element in the glow plug of FIG. 18.
Figure 19B:
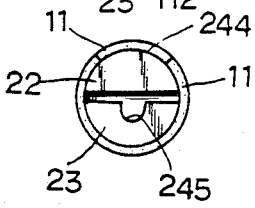
Figure 20:
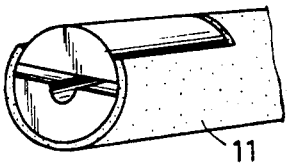
FIG. 20 is a perspective view of the element shown in FIG. 19.

Referring now to FIGS. 18 to 20, there are shown another glow plug according to this invention, and a ceramic heating element employed therein. The heating element 2 has two electrode portions 22 and 23. An electrically insulative ceramic layer 11 of equal thickness is provided on a part of the outer peripheral surface of the electrode portion 22, excluding a portion 244, and also on the entire outer periphery of the electrode portion 23. The ceramic layer 11 is composed mainly of $Al_2O_3$. A metallized layer 12 is formed on the surface of the portion 244, the surface 112 of the ceramic layer 11 and also the surface of a recess 245 in the electrode portion 23. Each metallized layer 12 comprises a layer of Mo on which Ni is plated. The metallized layers 12 on the electrode portions 22 and 23 have an equal thickness. The metallized layer 12 on the electrode portion 22 is joined by Ag brazing to the inner surface of a housing 3 at one end 301 thereof. The metallized layer 12 on the electrode portion 23 is joined by Ag brazing to a terminal 41 connected to a central electrode 4. The metallized layer 12 on the outer periphery of the electrode portion 23 is likewise bonded by Ag brazing to the inner surface of the housing 3 at one end 301 thereof. The space defined between the heating element 2 and the central electrode 4 is filled with a ceramic insulator 13 ($Al_2O_3$). Thus, the electrode portion 22 is electrically connected to the housing 3 by the metallized layer 12, and the electrode portion 23 to the terminal 41 and the central electrode 4 by the metallized layer 12.

The heating element shown in FIGS. 18 to 20 may be manufactured as will hereinafter be set forth. A wet mixture containing 30 parts by weight of TiC powder, 70 parts by weight of $Al_2O_3$ powder, 2.5 parts by weight of Ni powder and 1.0 part by weight of MgO powder is prepared, and dried. Five pars by weight of a 4% aqueous solution of methyl cellulose are admixed with 100 parts by weight of the mixed powder, and the resulting mixture is granulated. The ceramic powder thus obtained by granulation is compression molded into a columnar shape. A slit and electrode portions are appropriately formed in the molded product. A viscous slurry is prepared by admixing 1.0 part by weight of MgO powder, 8 parts by weight of polyvinyl butyral, 6 parts by weight of dibutyl phthalate and 40 parts by weight of ethanol with 70 parts by weight of $Al_2O_3$ powder. The slurry is cast in a uniform thickness on a polyester film, and dried to yield a flexible green sheet having a thickness of, say, 0.3 mm. The green sheet is cut to a desired shape, and stuck about the two electrode portions of the molded ceramic product by a 4% aqueous solution of methyl cellulose. A cut piece of the green sheet is also stuck to the open end of the slit. The heating element thus obtained is fired at 1,700° C. for two hours, and shows a specific resistance of $4\times10^{-3}$ Ωcm. The green sheet, which is composed mainly of $Al_2O_3$, combines with $Al_2O_3$ in the heating element to form a strong electrically insulating layer. The preparation of the heating element is completed if Mo is metallized appropriately, and nickel plated thereon.

The insulating layer 11 may be formed from a green sheet prepared from an insulating ceramic powder composed of for example, $Si_3N_4$, $SiO_2$, $Al_2O_3$, $TiO_2$, or MgO, or a mixture thereof, depending on the conditions under which the material of the heating element is fired, and the ability of the insulating material to combine with the heating element. The green sheet may be applied to the molded heating element which has been preliminarily or finally fired.

According to the arrangement shown in FIGS. 18 to 20, it is possible to ensure that the insulating layers 11 of equal thickness be firmly bonded to the electrode portions 22 and 23 of the heating element 2 to facilitate positioning of the heating element 2 and the housing 3 in axial alignment with each other, as well as reliable insulation between the electrode portion 23 and the housing 3.

FIGS. 21 to 25 show still another glow plug according to this invention. A ceramic heating element 2 has electrode portions 22 and 23 which are formed with grooves 202 and 203, respectively. Each of the grooves 202 and 203 defines a surface provided with a metallized layer composed of, for example, Mo and Ni plated thereon. A nickel terminal 41 or 42, as the case may be, is bonded by Ag brazing to the Ni plating. The terminal 41 has a bent end connected by Ag brazing to a central electrode 4, while the terminal 42 has a bent end connected by Ag brazing to the inner surface of a housing 3. The electrode portions 22 and 23 are secured within one end of an electrically insulative ceramic sleeve 15 which is filled with a ceramic insulator 16. Numeral 17 designates an electrically insulative glass or epoxy resin filler.

Figure 21:
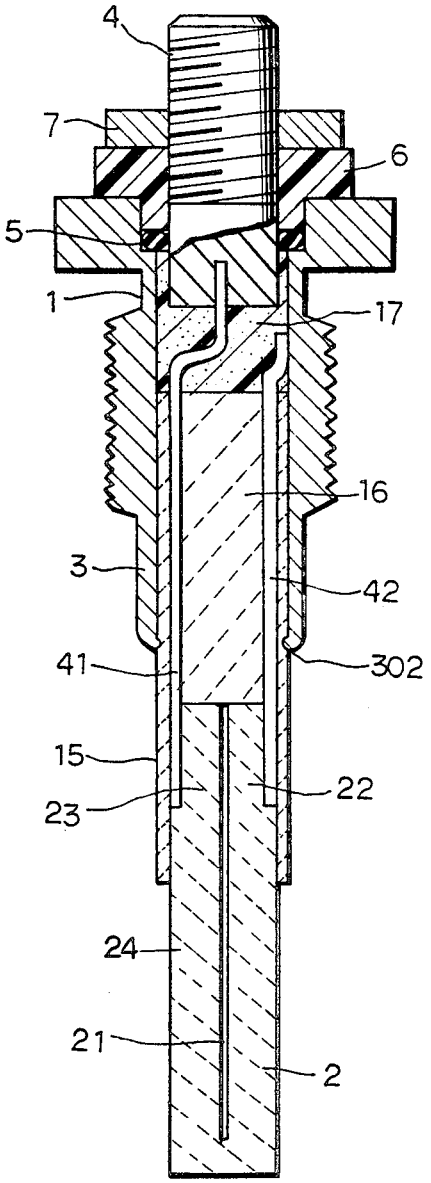
FIG. 21 is a longitudinal sectional view of still another glow plug according to this invention.
Figure 22:
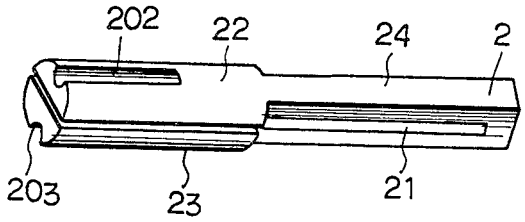
FIG. 22 is a perspective view of a ceramic heating element in the glow plug of FIG. 21.
Figure 23:
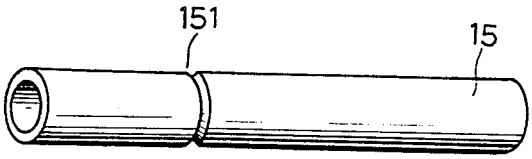
FIG. 23 is a perspective view of a sleeve in the glow plug of FIG. 21.
Figure 24:
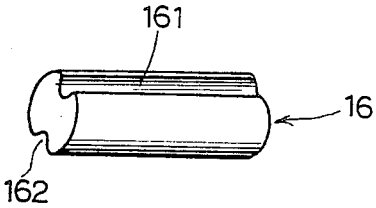
FIG. 24 is a perspective view of a ceramic member in the glow plug of FIG. 21.
Figure 25:
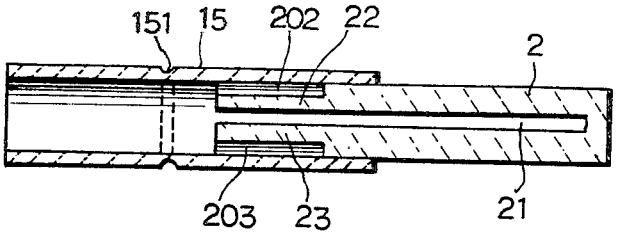
FIG. 25 is a longitudinal sectional view of the heating element of FIG. 22 and the sleeve of FIG. 23 put together.

The heating element 2 may be manufactured as will hereinafter be described. A wet mixture composed of 30 parts by weight of TiC powder, 70 parts by weight of $Al_2O_3$ powder, 2.5 parts by weight of Ni powder and 1.0 part by weight of MgO powder is prepared, and dried. Five parts by weight of a 4% aqueous solution of methyl cellulose are admixed with 100 parts by weight of the mixed powder, and the resulting mixture is granulated. The ceramic powder obtained by granulation is compression molded into a columnar shape. A slit 21, electrode portions 22 and 23, grooves 202 and 203, and a flat heat-generating portion 24 are formed by machining in the molded ceramic product, as shown in FIG. 22. Five parts by weight of a 4% aqueous solution of methyl cellulose are admixed with 100 parts by weight of a ceramic powder composed mainly of $Al_2O_3$. The ceramic powder obtained by granulation is compression molded into a hollow cylindrical shape, and a circumferential recess is formed in the midportion of the molded product as shown at 151 in FIG. 23. The electrode portions 22 and 23 are inserted into the hollow cylindrical product 15. The combined molded product is fired at 1,700° C. for two hours, and shown in longitudinal section in FIG. 25. The heating element 2 and the sleeve 15, of which both contain $Al_2O_3$, are fused with each other when they are fired. Then, molybdenum is metallized on the surfaces of the grooves 202 and 203 and nickel is plated on the surfaces of the molybdenum layers. A ceramic insulator 16 composed of alumina is inserted into the sleeve 15. Then, the terminals 41 and 42 are inserted into the sleeve 15 through the grooves 161 and 162 of the insulator 16 and the grooves 202 and 203 of the heating element 2. A silver braze is applied to the ends of the terminals 41 and 42 projecting from the sleeve 15. The sleeve 15 is inserted into the housing 3, and one of the terminals 41 and 42 is brought into contact with the inner surface of the housing 3, while the other terminal is engaged in a groove formed in the central electrode 4, but not shown. Then, one end 302 of the housing 3 is annually deformed into the recess 151 of the sleeve 15 as shown in FIG. 21. The whole assembly is placed in an electric furnace, so that the terminals 41 and 42 may be brazed at one end to the grooves 202 and 203 of the electrode portions 22 and 23 of the heating element 2, while the other ends of the terminals 41 and 42 are brazed to the central electrode 4 and the inner surface of the housing 3, respectively. Then, a molten epoxy resin is introduced into an annular space defined between the inner surface of the housing 3 and the outer surface of the central electrode 4, and solidified to form a seal 17. Finally, a seal ring 5, a bush 6 and a nut 7 are placed in position.

According to the arrangement shown in FIG. 21, the provision of the the sleeve 15 facilitates positioning of the heating element 2 and the housing 3 in axial alignment with each other, and ensures reliable electrical insulation therebetween. The sleeve also serves to hold the heating element 2 firmly in position, and prevent any transfer of heat from the heating element 2 to the housing 3.

The sleeve 15 may be formed from, for example, $Si_3N_4$, $SiO_2$, $TiO_2$ or $Al_2O_3$, or a mixture thereof, depending on the conditions under which the heating element 2 is fired, and the ability of the sleeve material to combine with the heating element 2. The heating element 2 and the sleeve 15 may be bonded to each other by a heat-resistant adhesive for an electrically insulating ceramic material. Moreover, it is possible to provide a metallized layer between the sleeve 15 and the housing 3 to braze the sleeve 15 to the housing 3.

What is claimed is:

1. A ceramic heater for an internal combustion engine comprising:

a cylindrical metal housing constructed and arranged to be mounted on an internal combustion engine;

a central electrode fixed to one end of said housing and electrically insulated from said housing;

a cylindrical ceramic insulating sleeve secured to the other end of said metal housing; and a heating element formed of a ceramic material for generating heat when supplied with electric power, said heat element having (i) an electrode section inserted into and secured to one end of said insulating sleeve, and having a first and a second electrode portions, and (ii) a heat generating section extending out of said insulating sleeve and having a first and a second heat generating portions to be directly exposed to an air-fuel mixture, both forward ends of said first and second heat generating portions being connected with each other, the cross-sectional area of said electrode section being larger than that of said heat generating section;

means for electrically connecting said first electrode portion with said metal housing; and means for electrically connecting said second electrode portion with central electrode.

2. A ceramic heater according to claim 1, further comprising:

a ceramic insulator inserted into the other end of said insulating sleeve, said ceramic insulator having a pair of grooves extending axially of said insulating sleeve, and said electrically connecting means being received in said pair of grooves, respectively.

* * * * *